US008125295B2

(12) United States Patent
Foged et al.

(10) Patent No.: US 8,125,295 B2
(45) Date of Patent: Feb. 28, 2012

(54) ORTHOGONAL-MODE COUPLER OF THE COAXIAL TYPE HAVING A BRANCHED CENTRAL CONDUCTOR

(75) Inventors: Lars Foged, Apilia (IT); Andrea Giacomini, Albano Laziale (IT); Luc Duchesne, Angervilliers (FR)

(73) Assignee: Ste d'Applications Technologiques de l'Imagerie Micro-Onde, Villebon sur Yvette (FR)

( * ) Notice: Subject to any disclaimer, the term of this patent is extended or adjusted under 35 U.S.C. 154(b) by 121 days.

(21) Appl. No.: 12/446,975

(22) PCT Filed: Oct. 18, 2007

(86) PCT No.: PCT/EP2007/061133

§ 371 (c)(1),
(2), (4) Date: Apr. 23, 2009

(87) PCT Pub. No.: WO2008/049776

PCT Pub. Date: May 2, 2008

(65) Prior Publication Data

US 2010/0033264 A1 Feb. 11, 2010

(30) Foreign Application Priority Data

Oct. 24, 2006 (FR) ..... 06 09333

(51) Int. Cl.
*H01P 1/161* (2006.01)

(52) U.S. Cl. ..... 333/125; 333/137; 333/26; 333/21 A

(58) Field of Classification Search ..... 333/21 A, 333/125, 126, 135, 137, 26
See application file for complete search history.

(56) References Cited

U.S. PATENT DOCUMENTS

2009/0027142 A1* 1/2009 Sanders ..... 333/21 A

FOREIGN PATENT DOCUMENTS

| | | | |
|---|---|---|---|
| EP | 0 222 086 | A2 | 5/1987 |
| EP | 0 285 879 | A1 | 10/1988 |
| JP | 07-254803 | A | 10/1995 |
| JP | 11-112202 | A | 4/1999 |

* cited by examiner

*Primary Examiner* — Benny Lee
(74) *Attorney, Agent, or Firm* — Blakely, Sokoloff, Taylor & Zafman

(57) ABSTRACT

The present invention relates to an orthogonal-mode junction coupler with an ultrabroad bandwidth or a wavelength waveguide noteworthy in that it includes what is called an external conductor (8) comprising a cavity (9) in which a central conductor (10) extends, said central conductor being electrically isolated at radiofrequencies with the external conductor (8), said central conductor (10) being supplied by supply lines (15, 16, 17, 18) passing through the external conductor (8) and emerging in the cavity (9) of said external conductor (8).

8 Claims, 2 Drawing Sheets

ORTHOGONAL-MODE COUPLER OF THE COAXIAL TYPE HAVING A BRANCHED CENTRAL CONDUCTOR

This is a non-provisional application claiming the benefit of International application number PCT/EP2007/061133 filed Oct. 18, 2007.

FIELD OF THE INVENTION

The present invention concerns an orthogonal-mode junction coupler with an ultrabroad operating bandwidth to separate dual-polarization bands propagating in a horn antenna, for example.

BACKGROUND OF THE INVENTION

In the field of radiofrequency antennas, it is well known to use orthogonal-mode junction couplers, or "ortho-mode junction" (OMJ) couplers, to separate dual-polarization bands.

For very broad operating frequency bands, these ortho-mode junction couplers are traditionally made up of a supply section of the waveguide in the shape of a cross comprising two central supply points, one supply point for each polarization, placed along the axis of the coupler, the points being offset along the axis of the coupler and ending with shield cavities in the rear.

This type of coaxial coupler has the drawback of being bulky and providing poor insulation between the two inlet ports of the supply points which are close to each other.

Furthermore, this type of coupler has an asymmetry which leads to degradation of the purity of the modal network due to the excitation of higher order modes.

SUMMARY OF THE INVENTION

One of the aims of the invention is therefore to resolve all of these drawbacks by proposing a particularly compact OMJ coupler with an ultrabroad bandwidth providing weak coupling between the input ports as well as a particularly stable ultrabroad bandwidth single-mode and bi-polarized excitation.

According to the invention, what is proposed is an orthogonal-mode junction coupler with an ultrabroad bandwidth for a wavelength waveguide which is remarkable in that the coupler comprises a so-called external conductor comprising a cavity in which a central conductor projects, the central conductor being electrically isolated at radiofrequencies with the external conductor, the central conductor being supplied by supply lines passing through the external conductor and emerging in the cavity of the external conductor.

The central conductor has a transverse cross-shaped section preferably having two orthogonal axes of symmetry.

Furthermore, the orthogonal-mode junction coupler according to the invention comprises four supply lines emerging in the cavity of the external conductor, each supply line being connected to a branch of the cross-shaped central conductor.

Preferably, each supply line is connected to a branch of the central conductor by an ohmic contact.

Two opposite branches the central conductor are supplied with radiofrequency signals by two opposite supply lines, respectively, to provide a given polarization.

To this end, the supply lines are connected to an external supply circuit determining the phase distribution of each signal sent by the supply lines.

According to one essential characteristic of the invention, the supply lines are connected to the central conductor in a same plane orthogonal to the axis of the central conductor.

BRIEF DESCRIPTION OF THE DRAWINGS

Other advantages and characteristics will better emerge from the description which follows, of a single embodiment provided as a non-limiting example, of the orthogonal-mode junction coupler with an ultrabroad bandwidth, in particular a coaxial coupler, according to the invention, from the appended drawings in which.

DETAILED DESCRIPTION OF THE INVENTION

Below is an OMJ coupler with an ultrabroad bandwidth according to the invention in order to separate the orthogonal dual-polarization bands of a coaxial circular radiating horn filled with a dielectric cone; however, it is obvious that the coupler according to the invention may be used alone and/or in any other application well known by One Skilled in the Art.

Figure 1:
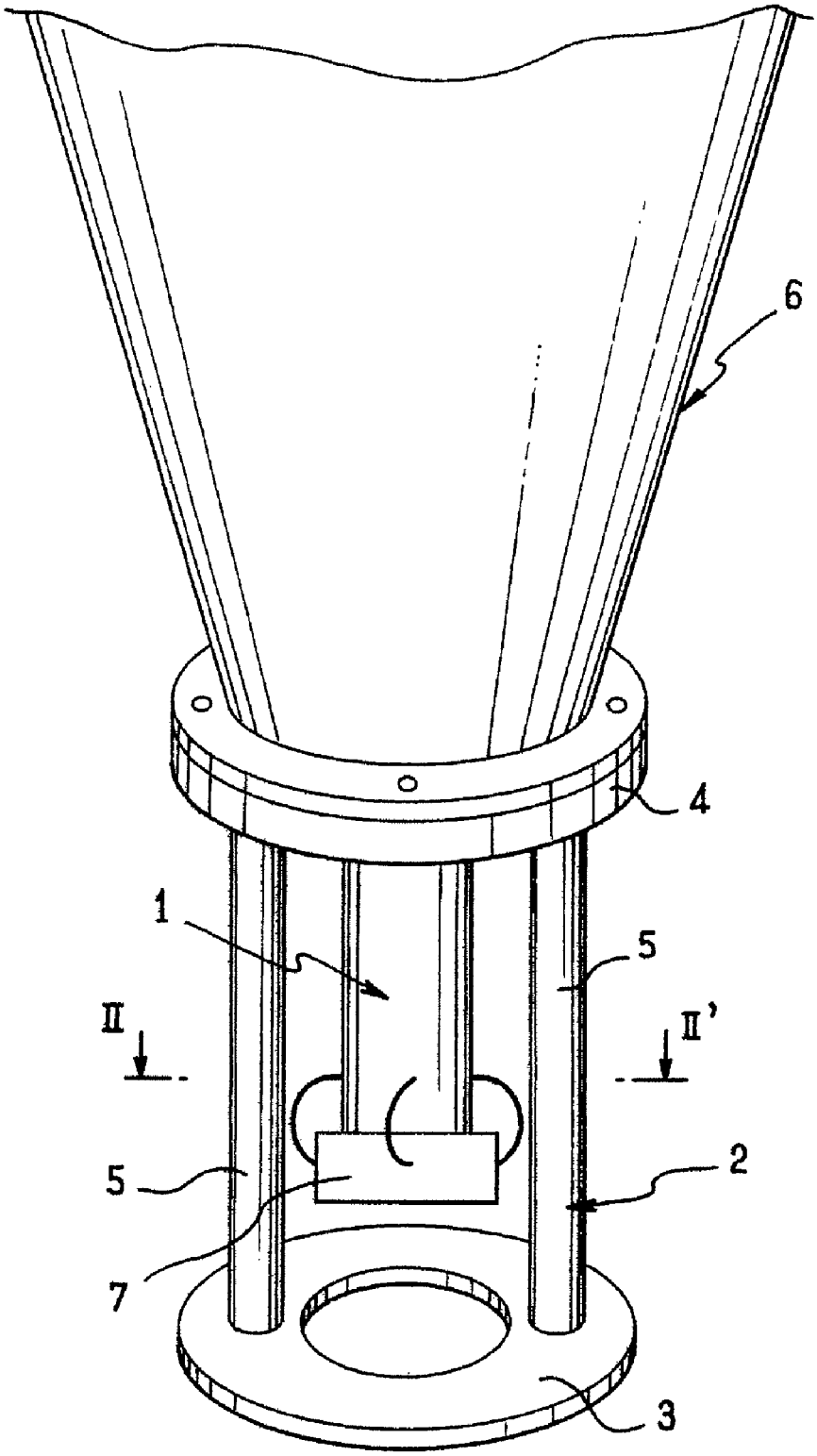
FIG. 1 is a perspective view of the coaxial OMJ coupler with an ultrabroad bandwidth according to the invention coupled to a horn antenna.

In reference to FIG. 1, the OMJ coupler 1 with an ultrabroad bandwidth according to the invention is supported by a support frame 2 made up of two crowns, a lower crown 3 and an upper crown 4 connected by spacers 5 in the form of cylindrical columns, the upper crown 4 supporting a horn antenna 6. The support frame 2 also supports an external supply circuit 7 of the coupler 1 which will be explained in detail later.

Figure 2:
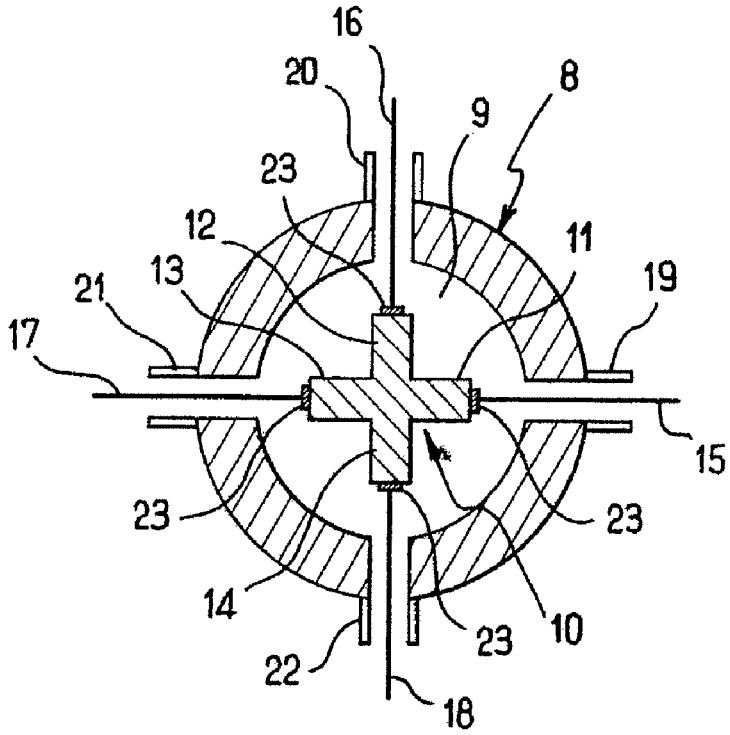
FIG. 2 is a diagrammatic transverse cross-sectional view of the coaxial OMJ coupler with an ultrabroad bandwidth according to the invention.
Figure 3:
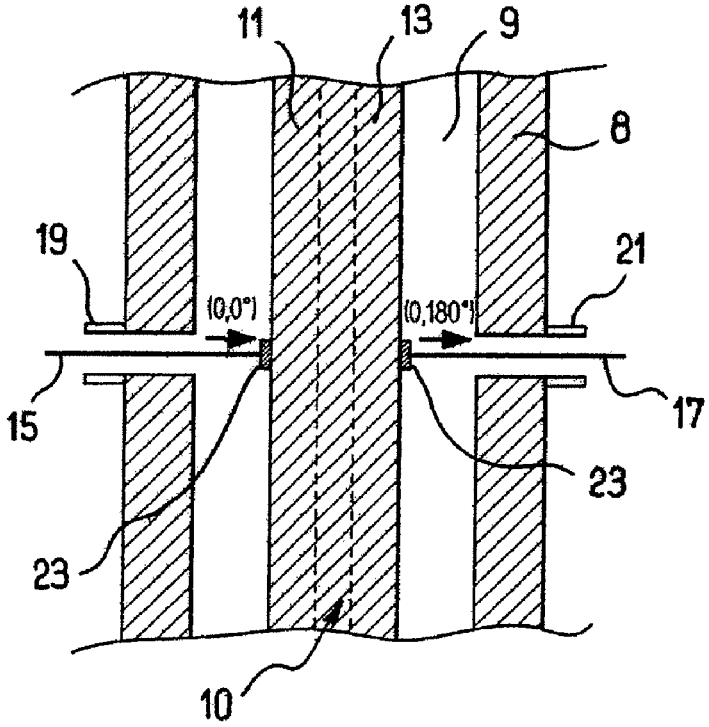
FIG. 3 is a diagrammatic longitudinal cross-sectional view of the coaxial OMJ coupler with an ultrabroad bandwidth according to the invention.

The coupler 1, in reference to FIGS. 2 and 3, comprises a so-called external conductor 8 comprising a cavity 9 in which a central conductor 10 extends, the central conductor being electrically isolated at radiofrequencies with the external conductor 8. It is to be noted that the central conductor is not electrically isolated at a discontinuous current.

The external conductor 8 includes a cylindrical tube having a coaxial cylindrical cavity 9.

Furthermore, the central conductor 10 has a cross-shaped transverse section comprising two orthogonal axes of symmetry. Thus, the central conductor 10 comprises four branches 11, 12, 13 and 14, opposite each other in pairs, as best shown in FIG. 2.

Furthermore, each branch 11, 12, 13 and 14 of the central conductor 10 is supplied by supply lines 15, 16, 17 and 18, respectively, passing through the external conductor 8 by inlet ports 19, 20, 21 and 22 and emerging into the cavity 9 of the external conductor 8, as best shown in FIG. 2.

Each supply line 15, 16, 17 and 18 is connected to a branch 11, 12, 13 and 14, respectively, of the central conductor 10 by an ohmic contact 23. The ohmic contact 23 will be obtained through any suitable means well known by One Skilled in the Art.

Particularly advantageously, and as shown in FIG. 3, the supply lines 15, 16 (not shown in FIG. 3), 17 and 18 (not shown in FIG. 3) are connected to each of the branches 11, 12 (not shown in FIG. 3), 13 and 14 (not, shown in FIG. 3), respectively, (through inlet ports 19, 20, 21, 22), of the central conductor 10 in a same plane orthogonal to the longitudinal axis of the central conductor 10.

Furthermore, the supply lines 15, 16, 17 and 18 are connected to the external supply circuit 7 (FIG. 1) determining the phase distribution of each signal sent by the supply lines 15, 16, 17 and 18. The supply circuit 7 (FIG. 1) supplies two opposite branches, for example (as shown in FIG. 3) branches 11 and 13, of the central conductor 10 with radiofrequency signals by the two respective opposite supply lines 15 and 17, respectively, in order to provide a determined polarization. For example, the supply circuit 7 supplies the branches 11 and 13 with radiofrequency signals having the phase distributions (0,0°) and (0, 180°), respectively passing through inlet sorts 19, 21, in order to provide a polarization of the branches 11 and 13 as diagrammatically illustrated by arrows in FIG. 3.

One will note that the electric symmetry of the coaxial OMJ coupler with an ultrabroad bandwidth according to the invention provides a stable single-mode and bi-polarized excitation with an ultrabroad bandwidth as well as weak coupling between the inlet ports of the supply lines. This weak coupling between the inlet ports makes it possible to do without an external compensating circuit.

Furthermore, the coaxial OMJ coupler with an ultrabroad bandwidth according to the invention is particularly compact given that the supply lines 15, 16, 17 and 18 are connected to each of the branches 11, 12, 13 and 14, respectively, of the central conductor 10 in a same plane orthogonal to the longitudinal axis of the central conductor 10.

It is quite clear that the coupler according to the invention may be obtained according to a precision trimming method well known by One Skilled in the Art or a method for manufacturing a multi-layer printed circuit, the multi-layer printed circuit being integrated into a waveguide, without, however, going beyond the scope of the invention. One will observe that, for a coupler obtained according to a printed circuit manufacturing method, the supply lines will be able to have an opposite direction.

Lastly, it goes without saying that the coaxial OMJ coupler with a medium or ultrabroad bandwidth according to the invention may be adapted for any other application well known by One Skilled in the Art and that the examples we have provided are in no way limiting as to the fields of application of the invention.

The invention claimed is:

1. An orthogonal-mode junction coupler with an ultrabroad bandwidth of a wavelength λ waveguide wherein the coupler comprises:

an external conductor comprising a cavity in which a central conductor extends, the central conductor being electrically isolated at radiofrequencies with the external conductor, the central conductor being supplied by supply lines passing through the external conductor and emerging in the cavity of the external conductor, the supply lines operably supplying the central conductor with radiofrequency signals, and each supply line being connected to a respective branch of the central conductor by a corresponding ohmic contact.

2. The orthogonal-mode junction coupler according to claim 1 wherein respective branches of the central conductor define a cross-shaped transverse section.

3. The orthogonal-mode junction coupler according to claim 2 wherein the supply lines are connected to an external supply circuit determining the phase distribution of each signal sent by the supply lines.

4. The orthogonal-mode junction coupler according to claim 1 wherein respective branches of the central conductor define two orthogonal axes of symmetry.

5. The orthogonal-mode junction coupler according to claim 2 or claim 4 wherein the supply lines comprise four supply lines.

6. The orthogonal-mode junction coupler according to claim 5 wherein two of the respective branches of the central conductor are opposite each other and are supplied with the radio frequency signals by two of the four supply lines that are opposite each other, in order to provide a determined polarization.

7. The orthogonal-mode junction coupler according to claim 1 wherein the supply lines are connected to the central conductor in a same plane.

8. The orthogonal-mode junction coupler according to claim 7 wherein a plane in which the connections of the supply lines to the central conductor extend is orthogonal to the axis of the central conductor.

* * * * *